US007938173B2

(12) United States Patent
Seno et al.

(10) Patent No.: US 7,938,173 B2
(45) Date of Patent: May 10, 2011

(54) HEAT EXCHANGER AND REFRIGERANT PASSAGE PORTION CONNECTING STRUCTURE FOR REFRIGERATION CYCLE

(75) Inventors: Yoshihiko Seno, Oyama (JP); Osamu Kamoshida, Oyama (JP); Takayuki Yasutake, Oyama (JP)

(73) Assignee: Showa Denko K.K., Tokyo (JP)

( * ) Notice: Subject to any disclaimer, the term of this patent is extended or adjusted under 35 U.S.C. 154(b) by 1296 days.

(21) Appl. No.: 10/590,202

(22) PCT Filed: May 10, 2005

(86) PCT No.: PCT/JP2005/008839

§ 371 (c)(1), (2), (4) Date: Aug. 22, 2006

(87) PCT Pub. No.: WO2005/108898

PCT Pub. Date: Nov. 17, 2005

(65) Prior Publication Data

US 2007/0163760 A1 Jul. 19, 2007

Related U.S. Application Data

(60) Provisional application No. 60/570,475, filed on May 13, 2004.

(30) Foreign Application Priority Data

May 10, 2004 (JP) ..... 2004-139328

(51) Int. Cl.
*F28F 9/04* (2006.01)
*F28B 1/00* (2006.01)

(52) U.S. Cl. ..... 165/178; 165/67; 62/509

(58) Field of Classification Search ..... 165/178, 165/76, 67, 110; 62/509; 285/10, 11, 9.2, 285/33, 41, 94, 139.2, 235, 327
See application file for complete search history.

(56) References Cited

U.S. PATENT DOCUMENTS 2,738,992 A * 3/1956 Heisler ..... 285/113

(Continued)

FOREIGN PATENT DOCUMENTS

JP 62-131286 8/1987

(Continued)

*Primary Examiner* — Tho v Duong
(74) *Attorney, Agent, or Firm* — Oblon, Spivak, McClelland, Maier & Neustadt, L.L.P.

(57) ABSTRACT

Fixed to the peripheral wall of a header 2 of a unit-type heat exchanger 1 is a receiver connecting block 6 having channels 31, 32 for causing the interior of the header 2 to communicate with the interior of a liquid receiver 7 therethrough. The block 6 and the liquid receiver 7 have respective fixing portions 32, 36 and respective contact faces 22*a*, 36*a* each provided on the fixing portion. The outer peripheral surfaces of the fixing portions 22, 36 have respective contours of the same shape and the same size. The liquid receiver 7 is fixed to the block 6 with the contact faces 22*a*, 36*a* of the fixing portions 22, 36 in intimate contact with each other. A tubular seal member 42 having rubber elasticity is liquid-tightly fitted around the fixing portions 22, 36. The seal member 42 has an inner shape smaller than the contours of the outer peripheral surfaces of the fixing portions 22, 36 and is fitted as elastically deformed around the fixing portions 22, 36. Rainwater or the like can be prevented from ingressing into an interstice between the contact faces of the block and the liquid receiver.

23 Claims, 7 Drawing Sheets

U.S. PATENT DOCUMENTS 2,739,829 A * 3/1956 Cundiff et al. ..... 285/21.2
4,023,834 A * 5/1977 Ewing et al. ..... 285/235
4,098,528 A * 7/1978 Stanley ..... 285/235
5,358,034 A * 10/1994 Nishishita et al. ..... 165/153
5,709,106 A * 1/1998 Inaba et al. ..... 62/507
5,884,678 A * 3/1999 Chudy ..... 141/319
5,988,270 A * 11/1999 Chevallier ..... 165/178

FOREIGN PATENT DOCUMENTS

JP 11-002475 1/1999
JP 2003-240386 8/2003

* cited by examiner

HEAT EXCHANGER AND REFRIGERANT PASSAGE PORTION CONNECTING STRUCTURE FOR REFRIGERATION CYCLE

CROSS REFERENCE TO RELATED APPLICATION

This application is an application filed under 35 U.S.C. §111(a) claiming the benefit pursuant to 35 U.S.C. §119(e)(1) of the filing date of Provisional Application No. 60/570,475, filed May 13, 2004 pursuant to 35 U.S.C. §111(b).

TECHNICAL FIELD

The present invention relates to heat exchangers for use in refrigeration cycles providing, for example, motor vehicle air conditioners, and structures for connecting refrigerant passage portions in refrigeration cycles.

The upper and lower sides of FIG. 1 will be referred to herein and in the appended claims as "upper" and "lower."

BACKGROUND ART

The combination of a header and a liquid receiver fixed thereto has been placed into use as a condenser in refrigeration cycles providing motor vehicle air conditioners so as to render the condenser easier to install in vehicle bodies and to reduce the installation space. Also placed into use are supercoolers for supercooling the liquid refrigerant as condensed by a condenser to a temperature about 5 to about 15° C. lower than the condensation temperature to achieve improvements in the refrigeration capacity of refrigeration cycles, and heat exchangers of the unit type are introduced into use in which a condenser portion having the function of a condenser and a supercooler portion having the function of a supercooler are provided in the form of a unit.

Such unit-type heat exchangers already known include those comprising a pair of headers extending upward or downward and spaced apart from each other, a plurality of refrigerant tubes arranged one above another in parallel at a spacing between the pair of headers and having opposite ends joined to the respective headers, fins arranged between respective adjacent pairs of refrigerant tubes, and a liquid receiver fixed to one of the headers. The receiver-fixed header and the other header are internally divided at portions thereof positioned at the same level to thereby provide a condenser portion having the function of a condenser and a supercooler portion positioned below the condenser portion and having the function of a supercooler, the receiver-fixed header having fixed to the peripheral wall thereof a receiver connecting block having channels permitting the refrigerant flowing out of the condenser portion to pass through the liquid receiver and to flow into the supercooler portion, the liquid receiver being fixed to the block, the block and the liquid receiver having respective contact faces to be brought into intimate contact with each other. The liquid receiver is fastened to the block with screws, with the contact faces of the block and the receiver in intimate contact with each other (see the publication of JP-A NO. 11-2475).

With the unit-type heat exchanger disclosed in the above publication, however, it is likely that rainwater or the like will ingress into an interstice between the contact faces of the block and the liquid receiver.

Refrigerant passage portions of refrigeration cycles, for example, pipes for use in a piping system of the cycle, are connected to each other by a refrigerant passage portion connecting structure which comprises a block fixed to one of the pipes and having a channel communicating with the pipe, and a block fixed to the other pipe and having a channel communicating with the other pipe, the two blocks having respective fixing portions and respective contact faces each provided on the fixing portion and to be positioned in intimate contact with each other, each of the channels having one end opened in the contact face, the two blocks being fastened together with the contact faces of their fixing portions in intimate contact with each other and with their channels communicating with each other.

However, with such a refrigerant passage portion connecting structure, rainwater or the like is likely to penetrate into an interstice between the contact faces of the two blocks.

An object of the present invention is to overcome the above problems and to provide a heat exchanger which is adapted to prevent rainwater or the like from ingressing into an interstice between the contact faces of a receiver connecting block and a liquid receiver, and a refrigerant passage portion connecting structure which is capable of preventing rainwater or the like from penetrating into an interstice between the contact faces of two blocks.

DISCLOSURE OF THE INVENTION

To fulfill the above object, the present invention comprises the following modes.

1) A heat exchanger comprising a pair of headers extending upward or downward and spaced apart from each other, a plurality of refrigerant tubes arranged one above another in parallel at a spacing between the pair of headers and having opposite ends joined to the respective headers, fins arranged between respective adjacent pairs of refrigerant tubes, and a liquid receiver fixed to one of the headers, a receiver connecting block being fixed to a peripheral wall of the receiver-fixed header and having channels for causing interior of the receiver-fixed header to communicate with interior of the liquid receiver therethrough, the liquid receiver being fixed to the connecting block, the connecting block and the liquid receiver being provided with respective fixing portions having respective contact faces in intimate contact with each other, the liquid receiver being fixed to the connecting block with the contact faces of the fixing portions in intimate contact with each other, a seal member being liquid-tightly provided around respective outer peripheral surfaces of both the fixing portions so as to cover a boundary between the contact faces of the fixing portion of the block and the fixing portion of the liquid receiver.

2) A heat exchanger according to par. 1) wherein the outer peripheral surfaces of the fixing portions of the block and the liquid receiver have respective contours of the same shape and the same size.

3) A heat exchanger according to par. 1) wherein the seal member covers the outer peripheral surfaces of the fixing portion of the block and the fixing portion of the liquid receiver each over a length of at least 5 mm in the direction of thickness of the fixing portion.

4) A heat exchanger according to par. 1) wherein the seal member is tubular and has rubber elasticity, and the tubular seal member has an inner shape smaller than the contours of the outer peripheral surfaces of the fixing portions of the block and the liquid receiver and is fitted as elastically deformed around both the fixing portion of the block and the fixing portion of the liquid receiver in intimate contact with the outer peripheral surfaces of both the fixing portions by virtue of the elastic force of the tubular seal member itself.

5) A heat exchanger according to par. 4) wherein the tubular seal member is provided in an inner peripheral surface thereof with a plurality of annular seal grooves over the entire circumference thereof.

6) A heat exchanger according to par. 4) wherein the outer peripheral surfaces of the fixing portions of the block and the liquid receiver have respective contours of the same shape and the same size, are each in the form of a cylindrical surface and each have a circular contour, the tubular seal member being cylindrical, and assuming that the outside diameter of the fixing portions of the block and the liquid receiver is d and that the inside diameter of the tubular seal member to be fitted around the fixing portions is D, these diameters have the relationship of $0.7d<D<d$.

7) A heat exchanger according to par. 4) wherein the tubular seal member is made from a rubber selected from the group consisting of silicone rubber, ethylene propylene rubber, butadiene-acrylonitrile rubber and hydrogenated butadiene-acrylonitrile rubber.

8) A heat exchanger according to par. 1) wherein the seal member comprises a thermally shrinkable tube.

9) A unit-type heat exchanger comprising a heat exchanger according to anyone of pars. 1) to 8) wherein the receiver-fixed header and the other header are internally divided at portions thereof at the same level to thereby provide a condenser portion having the function of a condenser and a supercooler portion positioned below the condenser portion and having the function of a supercooler, the receiver connecting block having channels permitting a refrigerant flowing out of the condenser portion to pass through interior of the liquid receiver and to flow into the supercooler portion.

10) A refrigeration cycle having a compressor, a condenser, an expansion valve and an evaporator, the condenser comprising a heat exchanger according to any one of pars. 1) to 8).

11) A vehicle having installed therein the refrigeration cycle according to par. 10) as an air conditioner.

12) A refrigeration cycle comprising a compressor, a unit-type heat exchanger according to par. 9), an expansion valve and an evaporator.

13) A vehicle having installed therein the refrigeration cycle according to par. 12) as an air conditioner.

14) A process for fabricating a heat exchanger according to par. 1) including: arranging a plurality of refrigerant tubes one above another in parallel at a spacing between a pair of headers extending upward or downward and spaced apart from each other, arranging fins between respective adjacent pairs of heat exchange tubes, providing a receiver connecting block for one of the headers and collectively brazing the resulting arrangement, applying a volatile lubricant to an outer peripheral surface of at least one of a fixing portion of the block and a fixing portion of a liquid receiver and thereafter fitting a tubular seal member around the outer peripheral surface of the fixing portion having the lubricant applied thereto, and fastening the liquid receiver to the block with contact faces of the fixing portions of the block and the liquid receiver in intimate contact with each other and thereafter shifting the tubular seal member to place the tubular seal member around both the fixing portions so as to cover a boundary between the contact faces of the fixing portions.

15) A refrigerant passage portion connecting structure for a refrigeration cycle comprising two blocks each having a channel communicating with a refrigerant passage portion of the refrigeration cycle, the two blocks having respective fixing portions and respective contact faces each provided on the fixing portion and to be positioned in intimate contact with each other, the channel having one end opened in the contact face, the two blocks being fastened together with the contact faces of their fixing portions in intimate contact with each other and with their channels communicating with each other, a seal member being liquid-tightly provided around outer peripheral surfaces of the fixing portions of the two blocks so as to cover a boundary between the contact faces of the fixing portions.

16) A refrigerant passage portion connecting structure for a refrigeration cycle comprising a first block having a channel communicating with a refrigerant passage portion of the refrigeration cycle, a pipe having an end portion fittable into the channel of the first block and connectable to the first block, and a second block for fixing the pipe to the first block, the two blocks having respective fixing portions and respective contact faces each provided on the fixing portion and to be positioned in intimate contact with each other, the two blocks being fastened together with the contact faces of their fixing portions in intimate contact with each other and with the pipe end portion fitted in the channel of the first block, a seal member being liquid-tightly provided around outer peripheral surfaces of the fixing portions of the two blocks so as to cover a boundary between the contact faces of the fixing portions.

17) A refrigerant passage portion connecting structure for a refrigeration cycle according to par. 15) or 16) wherein the outer peripheral surfaces of the fixing portions of the two blocks have respective contours of the same shape and the same size.

18) A refrigerant passage portion connecting structure for a refrigeration cycle according to par. 15) or 16) wherein the seal member covers the outer peripheral surfaces of the fixing portions of the two blocks each over a length of at least 5 mm in the direction of thickness of the fixing portion.

19) A refrigerant passage portion connecting structure for a refrigeration cycle according to par. 15) or 16) wherein the seal member is tubular and has rubber elasticity, and the tubular seal member has an inner shape smaller than the contours of the outer peripheral surfaces of the fixing portions of the two blocks and is fitted as elastically deformed around the fixing portions of the two blocks in intimate contact with the outer peripheral surfaces of the fixing portions by virtue of the elastic force of the tubular seal member itself.

20) A refrigerant passage portion connecting structure for a refrigeration cycle according to par. 19) wherein the tubular seal member is provided in an inner peripheral surface thereof with a plurality of annular seal grooves over the entire circumference thereof.

21) A refrigerant passage portion connecting structure for a refrigeration cycle according to par. 19) wherein the outer peripheral surfaces of the fixing portions of the two blocks have respective contours of the same shape and the same size, are each in the form of a cylindrical surface and each have a circular contour, the tubular seal member being cylindrical, and assuming that the outside diameter of the fixing portions of the two blocks is d and that the inside diameter of the tubular seal member to be fitted around the fixing portions is D, these diameters have the relationship of $0.7d<D<d$.

22) A refrigerant passage portion connecting structure for a refrigeration cycle according to par. 19) wherein the tubular seal member is made from a rubber selected from the group consisting of silicone rubber, ethylene propylene rubber, butadiene-acrylonitrile rubber and hydrogenated butadiene-acrylonitrile rubber.

23) A refrigerant passage portion connecting structure for a refrigeration cycle according to par. 15) or 16) wherein the seal member comprises a thermally shrinkable tube.

24) A process for fabricating a refrigerant passage portion connecting structure for a refrigeration cycle according to par.

15) or 16) including: applying a volatile lubricant to an outer peripheral surface of a fixing portion of at least one of two blocks and thereafter fitting a tubular seal member around the outer peripheral surface of the fixing portion having the lubricant applied thereto, and fastening the two blocks together with contact faces of the fixing portions of the blocks in intimate contact with each other and thereafter shifting the tubular seal member to place the tubular seal member around both the fixing portions so as to cover a boundary between the contact faces of the fixing portions.

With the heat exchanger according to par. 1), the liquid receiver is fixed to the connecting block with the contact faces of the fixing portions of the block and receiver in intimate contact with each other, and the seal member is liquid-tightly provided around respective outer peripheral surfaces of both the fixing portions so as to cover a boundary between the contact faces of the fixing portions of the block and the receiver. Rainwater or the like can therefore be prevented from ingressing into an interstice between the contact face of the block fixing portion and the contact face of the receiver fixing portion by the function of the seal member. This precludes corrosion from developing in the contact faces.

With the heat exchanger according to pars. 2) and 3), the seal member acts to produce an improved effect to prevent rainwater or the like from penetrating into the interstice between the contact faces of the fixing portions of the block and the receiver.

With the heat exchanger according to par. 4), the tubular seal member is in intimate contact with the outer peripheral surfaces of the fixing portions of the block and the liquid receiver, so that the tubular seal member produces a further improved effect to prevent rain water or the like from penetrating into the interstice between the contact faces of the fixing portions of the block and the receiver.

With the heat exchanger according to par. 5), even if a small amount of rainwater ingresses from an end portion of the tubular seal member into a clearance between the tubular seal member and the outer peripheral surfaces of the contact faces of the block and receiver fixing portions, the rainwater is trapped in annular seal grooves in the seal member inner peripheral surface and is therefore prevented from penetrating into the interstice between the contact faces.

With the heat exchanger according to par. 6), the tubular seal member is reliably in intimate contact with the outer peripheral surfaces of the block and receiver fixing portions, acting to produce a further improved effect to prevent rainwater or the like from ingressing into the interstice between the contact faces of the block and receiver fixing portions. The tubular seal member can nevertheless be fitted around the fixing portions free of any trouble by the process described in par. 14).

With the heat exchanger according to par. 7), the tubular seal member has high corrosion resistance.

With the heat exchanger according to par. 8), the seal member in intimate contact with the outer peripheral surfaces of the block and receiver fixing portions functions to produce a further improved effect to prevent rainwater or the like from ingressing into the interstice between the contact faces of the fixing portions.

The heat exchanger according to par. 9) produces the same effects as in the heat exchanger according to pars. 1) to 8).

The process of par. 14) for fabricating the heat exchanger includes applying a volatile lubricant to the outer peripheral surface of at least one of the fixing portion of the block and the fixing portion of the liquid receiver, thereafter fitting a tubular seal member around the outer peripheral surface of the fixing portion having the lubricant applied thereto, fastening the liquid receiver to the block with contact faces of the fixing portions of the block and the liquid receiver in intimate contact with each other, and thereafter shifting the tubular seal member to place the tubular seal member around both the fixing portions so as to cover a boundary between the contact faces of the fixing portions. The tubular seal member is easily shiftable by the action of the volatile lubricant and can therefore be provided in place smoothly. Since the lubricant vaporizes after the installation of the seal member, the seal member will not easily shift after the vaporization of the lubricant.

With the refrigerant passage portion connecting structure according to par. 15), the two blocks are fastened together with the contact faces of their fixing portions in intimate contact with each other and with their channels communicating with each other, and the seal member is liquid-tightly provided around outer peripheral surfaces of the fixing portions of the two blocks so as to cover a boundary between the contact faces of the fixing portions. Rain water or the like can therefore be prevented from ingressing into an interstice between the contact faces of fixing portions of the two blocks by the function of the seal member. This precludes corrosion from developing in the contact faces.

With the refrigerant passage portion connecting structure according to par. 16), the two blocks are fastened together with the contact faces of their fixing portions in intimate contact with each other and with the pipe end portion fitted in the channel of the first block, and the seal member is liquid-tightly provided around the outer peripheral surfaces of fixing portions of the two blocks so as to cover the boundary between the contact faces of the fixing portions. Rainwater or the like can therefore be prevented from ingressing into an interstice between the contact faces of fixing portions of the two blocks by the function of the seal member. This precludes corrosion from developing in the contact faces.

With the refrigerant passage portion connecting structure according to pars. 17) and 18), the seal member functions to produce an improved effect to prevent rainwater or the like from ingressing into the interstice between the contact faces of the fixing portions.

With the refrigerant passage portion connecting structure according to par. 19), the tubular seal member is in intimate contact with the outer peripheral surfaces of the two blocks and therefore functions to produce a further improved effect to prevent rainwater or the like from ingressing into the interstice between the contact faces of the fixing portions.

With the refrigerant passage portion connecting structure according to par. 20), even if a small amount of rainwater ingresses from an end portion of the tubular seal member into a clearance between the tubular seal member and the outer peripheral surfaces of fixing portions of the two blocks, the rainwater is trapped in annular seal grooves in the seal member inner peripheral surface and is therefore prevented from penetrating into the interstice between the contact faces of fixing portions of the two blocks.

With the refrigerant passage portion connecting structure according to par. 21), the tubular seal member is reliably in intimate contact with the outer peripheral surfaces of fixing portions of the two blocks, acting to produce a further improved effect to prevent rainwater or the like from ingressing into the interstice between the contact faces of the block fixing portions. The tubular seal member can nevertheless be fitted around the fixing portions free of any trouble by the process described in par. 24).

With the refrigerant passage portion connecting structure according to par. 22), the tubular seal member has high corrosion resistance.

With the refrigerant passage portion connecting structure according to par. 23), the seal member is in intimate contact with the outer peripheral surfaces of the two blocks and therefore functions to produce a further improved effect to prevent rainwater or the like from ingressing into the interstice between the contact faces of the fixing portions.

The process of par. 24) for fabricating a refrigerant passage portion connecting structure includes applying a volatile lubricant to the outer peripheral surface of a fixing portion of at least one of two blocks, thereafter fitting a tubular seal member around the outer peripheral surface of the fixing portion having the lubricant applied thereto, subsequently fastening the two blocks together with contact faces of the fixing portions of the blocks in intimate contact with each other, and thereafter shifting the tubular seal member to place the tubular seal member around both the fixing portions so as to cover a boundary between the contact faces of the fixing portions. The tubular seal member can therefore be shifted easily by the action of the volatile lubricant and installed in place smoothly. Since the lubricant vaporizes after the installation of the seal member, the seal member will not easily shift after the vaporization of the lubricant.

BEST MODE OF CARRYING OUT THE INVENTION

Embodiments of the invention will be described below with reference to the drawings.

In the following description, the term "aluminum" includes aluminum alloys in addition to pure aluminum. Also in the following description, the upper and lower sides, and left- and right-hand sides of the drawings other than FIGS. 3 to 5 will be referred to as "upper," "lower," "left" and "right," respectively. The front side of the plane of paper bearing FIG. 1 will be referred to as the "front," and the rear side thereof as the "rear."

Embodiment 1

This embodiment is shown in FIGS. 1 to 4 and is a unit-type heat exchanger according to the invention and comprising a condenser portion having the function of a condenser and a supercooler portion having the function of a supercooler which are in the form of a unit.

Figure 1:
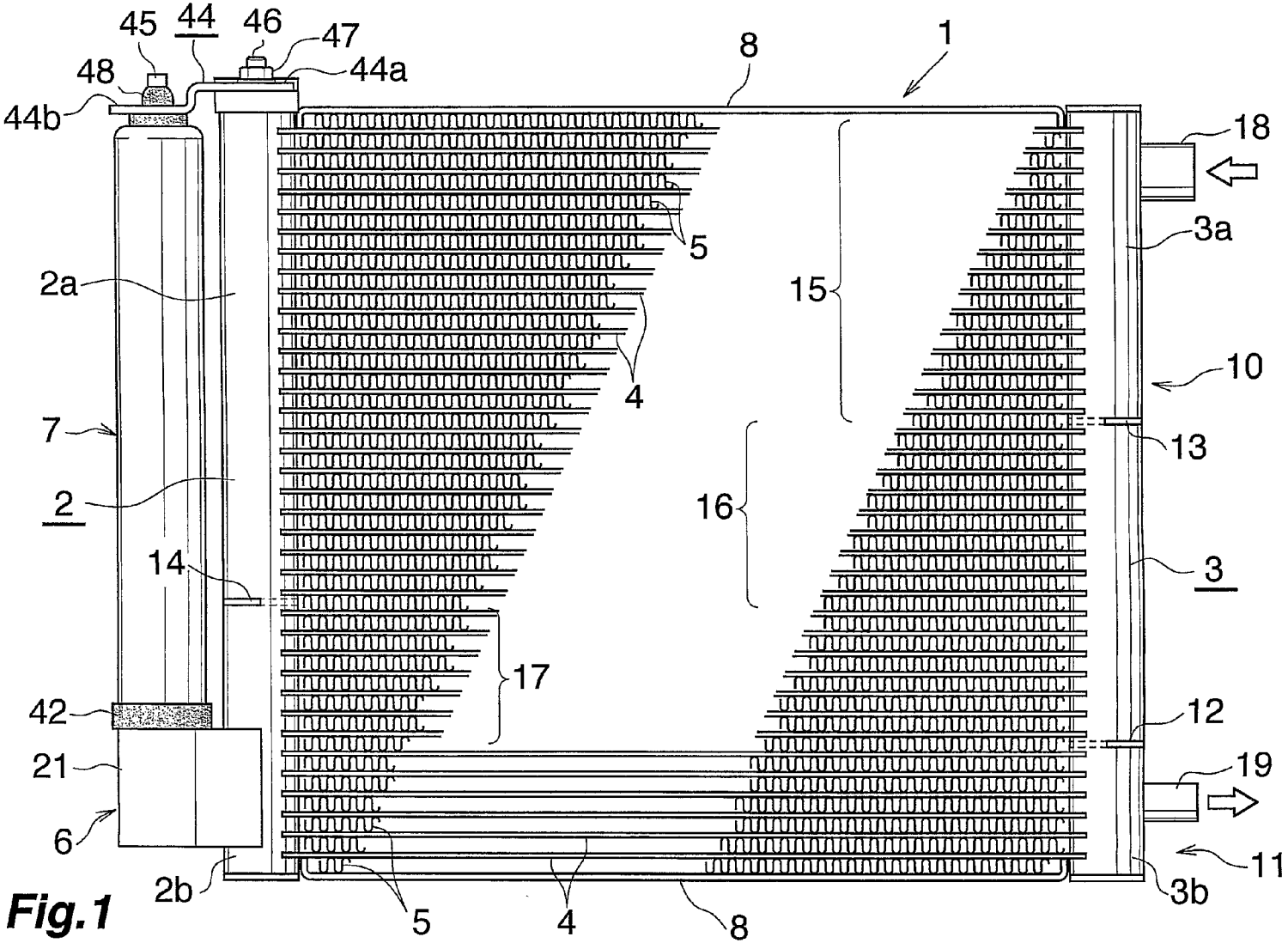
FIG. 1 is a fragmentary front view showing a unit-type heat exchanger as embodiment of heat exchanger of the invention.
Figure 2:
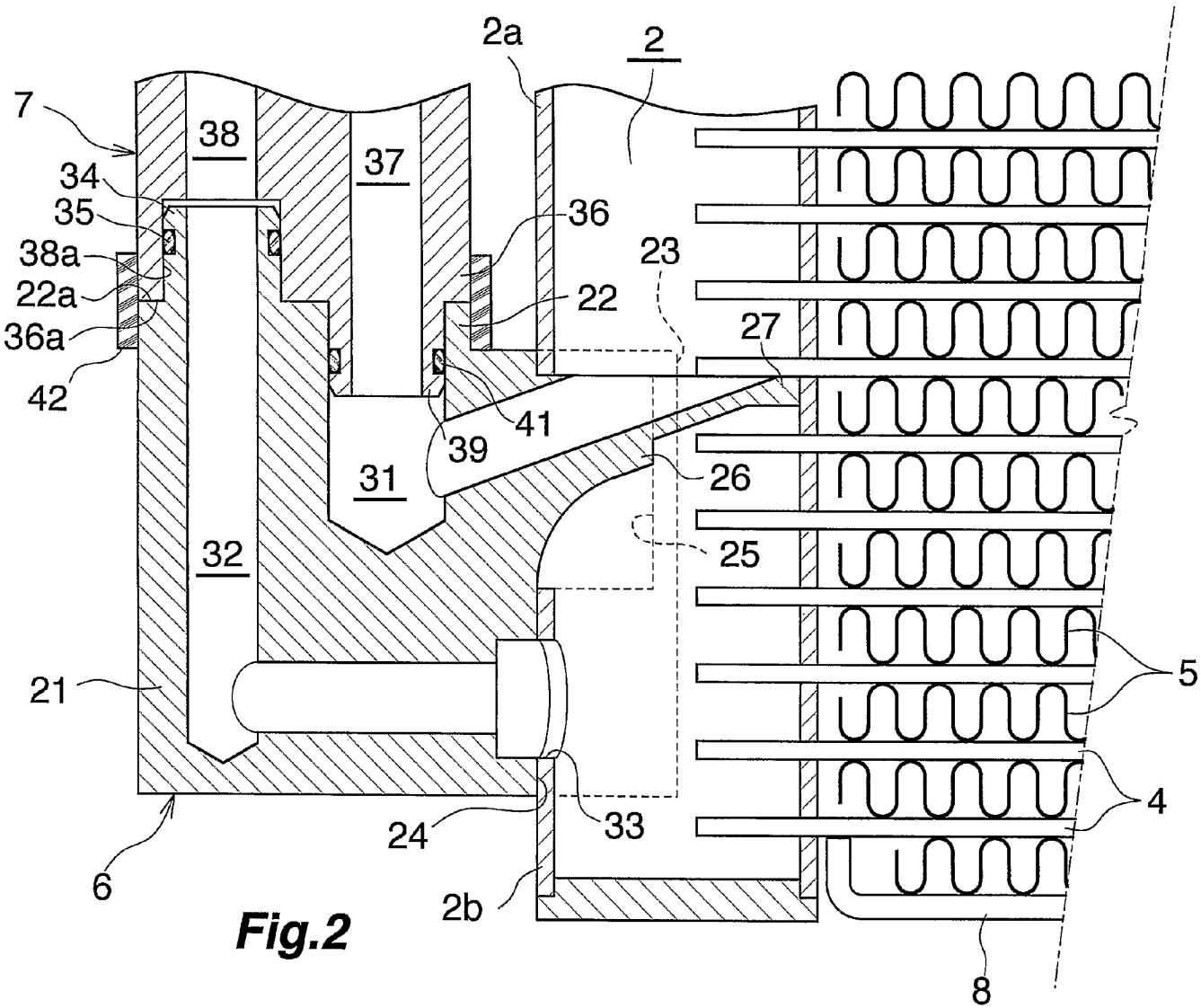
FIG. 2 is an enlarged fragmentary view in vertical section of the unit-type heat exchanger.
Figure 3:
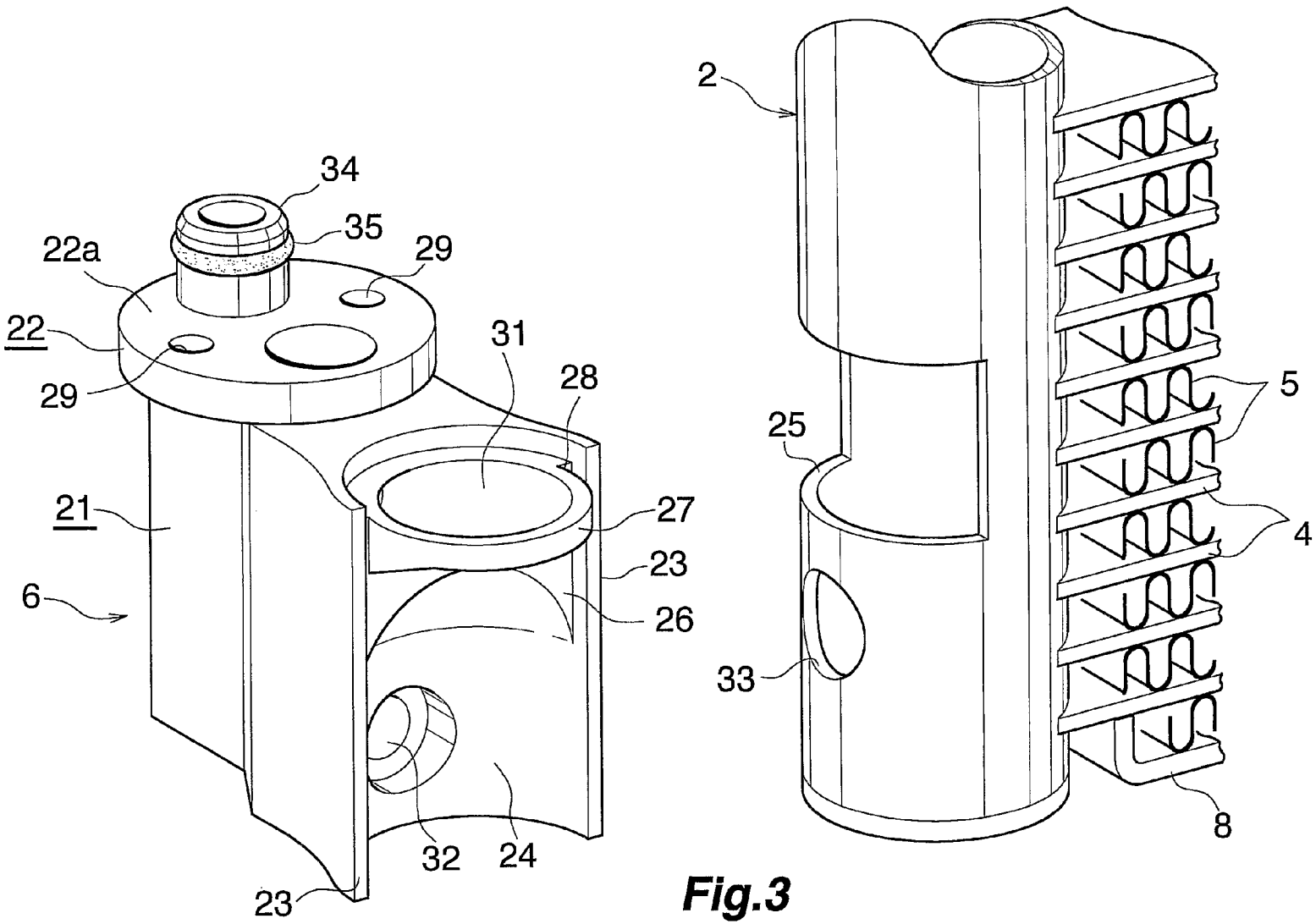
FIG. 3 is an exploded fragmentary perspective view showing the heat exchanger of FIG. 1 on an enlarged scale.
Figure 4:
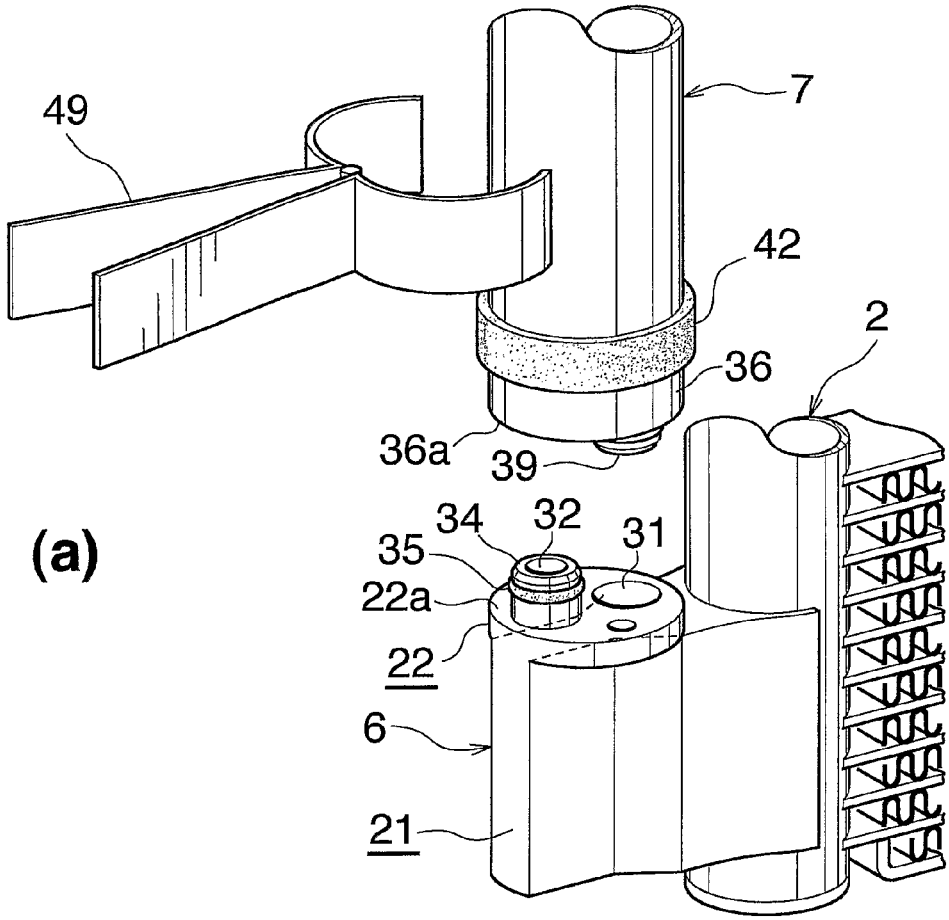
FIG. 4 is a perspective view showing some steps of a process for fabricating the unit-type heat exchanger of FIG. 1.
Figure 4:
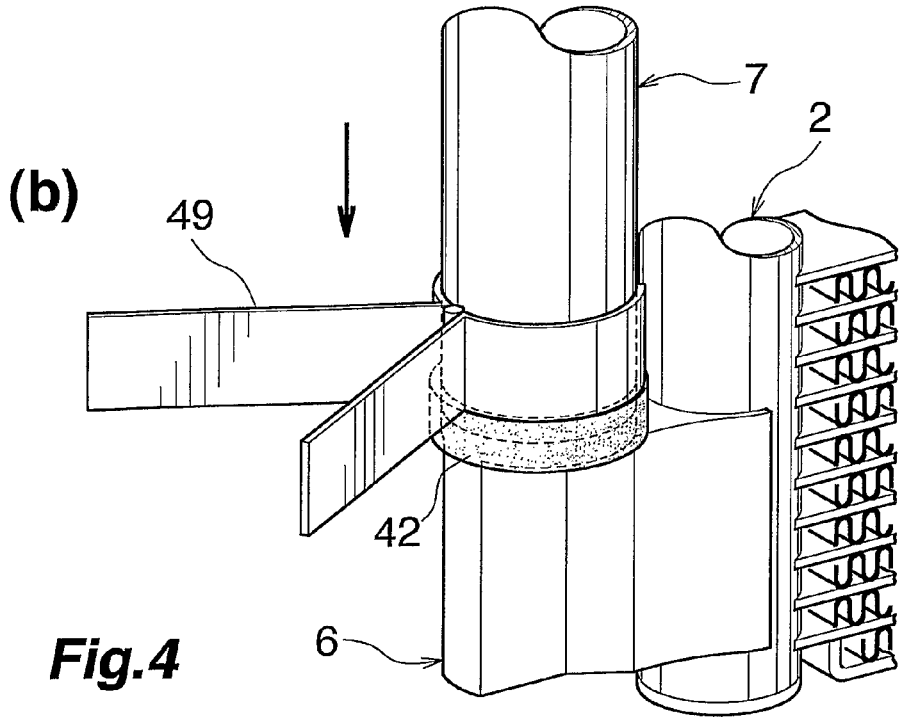

FIG. 1 shows the overall construction of the heat exchanger of the unit type, and FIGS. 2 and 3 show the constructions of the main portions thereof. FIG. 4 shows some steps of a process for fabricating the unit-type heat exchanger.

With reference to FIG. 1, the heat exchanger 1 comprises a pair of left and right aluminum headers 2, 3 extending upward or downward and spaced apart from each other, a plurality of aluminum refrigerant tubes 4 arranged between the headers 2, 3 in parallel upward or downward at a spacing and joined at opposite ends to the headers 2, 3 by brazing, corrugated aluminum fins 5 arranged between and brazed to respective adjacent pairs of refrigerant tubes 4, a receiver connecting aluminum block 6 fixed by brazing to the left header 2 which is a receiver-fixed header, and a liquid receiver 7 fixed to the connecting block 6. Two aluminum side plate 8 are respectively provided above and space apart from the refrigerant tube 4 at the upper end and below and spaced apart from the refrigerant tube 4 at the lower end. A corrugated aluminum fin 5 is provided also between each side plate 8 and the refrigerant tube 4 adjacent thereto and brazed to the plate 8 and the tube 4.

The two headers 2, 3 of the heat exchanger 1 are internally divided into an upper and a lower portion at low portions thereof at the same level to provide a condenser portion 10 having the function of a condenser to condense a refrigerant of vapor phase to a liquid phase, and a supercooler portion 11 positioned in the same vertical plane as the condenser portion 10 and under the portion 10 and having the function of a supercooler to supercool the liquid refrigerant condensed by the condenser portion 10 to a temperature about 5 to about 15° C. lower than the condensation temperature, the two portions 10, 11 being provided in the form of a unit. The left header 2 has its interior divided into an upper and a lower portion by a partition portion 27 integral with the receiver connecting block 6 as will be described later. The right header 3 has its interior divided into an upper and lower portion by an aluminum partition plate 12.

The portion of the left header 2 above the partition portion 27 of the connecting block 6 will be referred to as the "condenser left header portion 2*a*," the portion of the same header 2 below the partition portion 27 as the "supercooler left header portion 2*b*," the portion of the right header 3 above the partition plate 12 as the "condenser right header portion 3*a*," and the portion of the same header 3 below the partition plate 12 as the "supercooler right header portion 3*b*."

A first partition plate 13 of aluminum is provided inside the condenser right header portion 3*a* at the midportion thereof with respect to the height, and a second partition plate 14 of aluminum is provided inside the condenser left header portion 2*a* at a lower part thereof. Channel groups 15, 16, 17 each comprising refrigerant tubes 4 arranged successively upward or downward are provided in the condenser portion 10 respectively at the upper part thereof above the first partition plate 13, at the part thereof between the two partition plates 13, 14, and at the lower part below the second partition plate 14. The number of refrigerant tubes 4 in each of the channel groups 15 to 17 successively decreases from above downward. All refrigerant tubes 4 in each channel group are the same in the direction of flow of the refrigerant therethrough, and each adjacent pair of channel groups 15 and 16, or 16 and 17 are different in the direction of flow of the refrigerant through the tubes 4. A refrigerant inlet member 18 is brazed to the upper end of the condenser right header portion 3*a* so as to communicate with the interior of this header portion 3*a*. A refrigerant outlet member 19 is brazed to the supercooler right header portion 3*b* so as to communicate with the interior of this header portion 3*b*.

As shown in FIGS. 2 and 3, the receiver connecting block 6 comprises a block body 21 and a fixing portion 22 formed on the upper end of the block body 21 integrally therewith and projecting upward from the block body 21.

The block body 21 is integrally provided with a ridge 23 extending vertically and formed at each of front and rear side edges of the right side wall thereof. A recessed portion 24 is formed in a lower part of the portion between the two ridges 23 on the right side wall of the block body 21 and has an inner peripheral surface in the form of a recessed cylindrical surface adapted for intimate contact with the outer periphery of the left header 2. The block body 21 has a fitting portion 26 positioned above the recessed portion 24 and fitting into the left header 2 through a rectangular hole 25 formed in the left header 2. The fitting portion 26 has an upper-end peripheral edge portion providing the partition portion 27 in contact with the inner periphery of the left header 2 and dividing the interior of the left header 2 into the condenser left header portion 2*a* and the supercooler left header portion 2*b*. Formed in the block body 21 between each of front and rear edges of the fitting portion 26 and the corresponding ridge 23 is a cutout 28 for the front or rear side portion of the peripheral wall of the left header 2 defining the rectangular hole 25 to fit in. The junction between the inner peripheral surface of the recessed portion 24 and the lower surface of the fitting portion 26 has a concave surface. The receiver block 6 is fixed to the left header 2 by brazing the inner side faces of the two ridges 23 of the block body 21 and the inner peripheral surface of the recessed portion 24 thereof to the outer peripheral surface of the left header 2, and the partition portion 27 of the fitting portion 26 to the inner peripheral surface of the left header 2.

The fixing portion 22 is in the form of a solid cylinder having a vertical length of at least 5 mm, and has an outer periphery in the form of a cylindrical surface and a circular contour. The fixing portion 22 has a top providing a flat intimate contact face 22*a* to be brought into intimate contact with the lower face of a fixing portion 36 of the liquid receiver 7 which portion will be described below. The fixing portion 22 has front and rear opposite side parts extending outward beyond the block body 6, and a bore 29 vertically extends through each of these extensions.

The liquid receiver connecting block 6 has first and second two channels 31, 32. The first channel 31 has one end provided with an opening in an upper face of the fitting portion 26 and the other end provided with an opening in a right side area of the intimate contact face 22*a* of the fixing portion 22. The second channel 32 has one end provided with an opening in a bottom area of inner peripheral surface of the recessed portion 24 and the other end provided with an opening in a left side area of the intimate contact face 22*a* of the fixing portion 22. The one-end opening of the second channel 32 communicates with the interior of the supercooler left header portion 2*b* through a circular through hole 33 formed in the peripheral wall of the left header 2. A male pipe portion 34 projecting upward is provided around the other-end opening of the second channel 32 formed in the face 22*a* of the fixing portion 22. An O-ring 35 is provided around the male pipe portion 34.

The liquid receiver 7 is a tubular body having a closed upper end and an open lower end and has at its lower end the above-mentioned fixing portion 36 fixed to the fixing portion 22 of the connecting block 6. The fixing portion 36 is in the form of a solid cylinder having a vertical length of at least 5 mm and has an outer periphery in the form of a cylindrical surface and a circular contour. The fixing portion 36 has an outside diameter equal to that of the fixing portion 22 of the connecting block 6. This gives the same shape and size to the respective contours of the outer peripheries of the fixing portions 22, 36 of the connecting block 6 and the liquid receiver 7. Incidentally, the outer peripheries of the fixing portions 22, 36 may be slightly different in contour. The bottom face of the fixing portion 36 is in the form of a flat intimate contact face 36*a* in intimate contact with the face 22*a* of the fixing portion 22 of the connecting block 6.

The fixing portion 36 of the liquid receiver 7 is provided with a first channel 37 having one-end opening in the intimate contact face 36*a* and communicating with the first channel 31 of the connecting block 6, and with a second channel 38 having one-end opening in the intimate contact face 36*a* and communicating with the second channel 32 of the block 6. Provided around the opening of the first channel 37 in the intimate contact face 36*a* of the fixing portion 36 integrally with this portion 36 is a male pipe portion 39 projecting downward and to be inserted into the other-end opening of the first channel 31 of the block 6. An O-ring 41 is provided around the pipe portion 39. The fixing portion 36 is provided at the lower end of the second channel 38 with a large-diameter portion 38*a* for the male pipe portion 34 of the connecting block 6 to be inserted in. Although not shown, threaded bores are formed in the front and rear opposite side areas of the contact face 36*a* of the fixing portion 36 so as to be in register with the respective through bores 29 of the block 6.

Although not shown, the liquid receiver 7 is formed by welding a plurality of members by arc welding and internally provided with a filter for removing extraneous matter from the refrigerant and a dryer for absorbing water from the refrigerant (neither shown).

The liquid receiver 7 is fixed to the receiver connecting block 6 by driving male screws (not shown) inserted through the respective bores 29 of the block 6 from below into the respective threaded bores of the receiver 7, with the fixing portion 36 of the liquid receiver 7 placed on the fixing portion 22 of the block 22, with the male pipe portion 39 of the receiver 7 inserted in the first channel 31 of the block 6, with the male pipe portion 34 of the block 6 fitted in the large-diameter portion 38*a* of the second channel 38 of the receiver 7 and with the faces 22*a*, 36*a* of the two fixing portions 22, 36 in intimate contact with each other.

A cylindrical seal member 42 is liquid-tightly provided around the two fixing portions 22, 36 so as to cover the boundary between the contact faces 22*a*, 36*a* of the fixing portion 22 of the block 6 and the fixing portion 36 of the liquid receiver 7. It is desired that the seal member 42 cover the fixing portion 22 of the connecting block 6 and the fixing portion 36 of the liquid receiver 7 each over a length of at least 5 mm in the direction of thickness of the fixing portion (upward or downward direction). If the length of the outer periphery of each of the fixing portions 22, 36 covered with the seal member 42 is less than 5 mm, it is likely that, for example, rainwater or the like will flow through the clearance between the inner surface of the seal member 42 and the outer surface of each fixing member to ingress into the interstice between the contact faces 22*a*, 36*a*. The cylindrical seal member 42 has rubberlike elasticity. The seal member 42, which has an inside diameter smaller than the outside diameter of the fixing portions 22, 36 of the block 6 and the liquid receiver 7, is elastically deformed and fitted around both the block fixing portion 22 and the receiver fixing portion 36 in intimate contact with the outer peripheries of both the fixing portions 22, 36 by virtue of its own elasticity. Stated more specifically, the cylindrical seal member 42 is made from one rubber selected from the group consisting of silicone rubber, ethylene propylene rubber, butadiene-acrylonitrile rubber and hydrogenated butadiene-acrylonitrile rubber. Before the seal member 42 is fitted around the fixing portions, the inside diameter of the member is smaller than the outside diameter of the fixing portions 22, 36. Assuming that the outside diameter of the fixing portions 22, 36 of the receiver connecting block 6 and the liquid receiver 7 (the diameter of the combined contour of the outer peripheries of the two fixing portions 22, 36) is d, and that the inside diameter of the seal member 42 before installation is D, it is desired that these diameter have the relationship of $0.7d<D<d$. If $D \leqq 0.7d$, it is likely that the seal member 42 will be difficult to fit around the fixing portions, while if $D \geqq d$, there is the likelihood that rainwater or the like will ingress into the interstice between the contact faces 22*a*, 36*a* through the clearance between the inner periphery of the seal member 42 and the outer peripheries of the fixing portions 22, 36. The materials for making the seal member 42 are not limited to those exemplified above.

Figure 5:
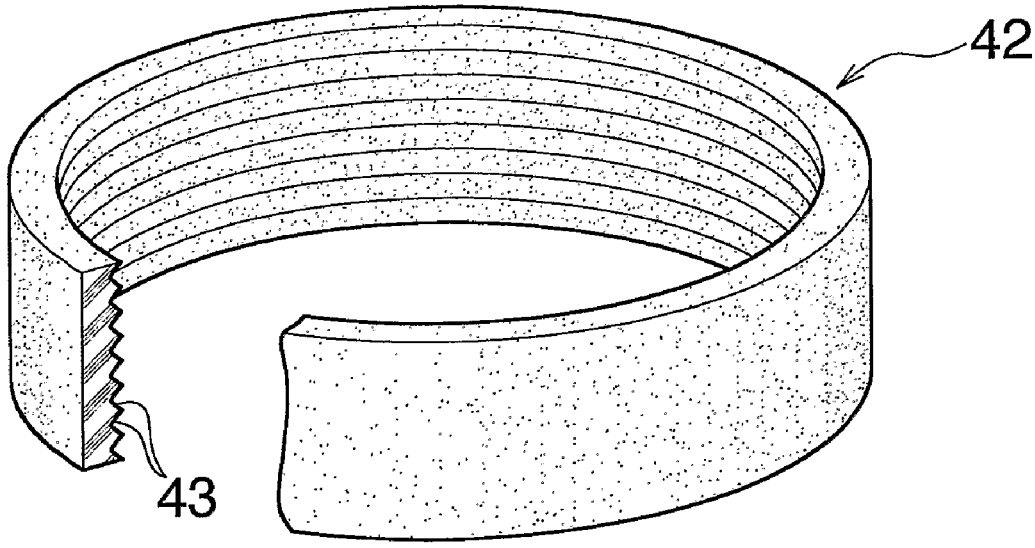
FIG. 5 is a fragmentary perspective view of a modified seal member for use in the unit-type heat exchanger of FIG. 1.

Preferably, the cylindrical seal member 42 is provided in its inner periphery with a plurality of annular seal grooves 43 over the entire circumference thereof as shown in FIG. 5. Even if a small amount, for example, of rainwater ingresses into the clearance between the seal member 42 and the outer peripheries of fixing portions 22, 36 of the block 6 and the liquid receiver 7 from one end of the seal member 42 in this case, the rainwater will be trapped in annular seal grooves 43 in the inner periphery of the seal member 42 and is reliably prevented from penetrating into the interstice between the contact faces 22*a*, 36*a* of fixing portions 22, 36 of the block and the receiver 7.

The liquid receiver 7 has an upper end portion which is fixed to the left header 2 by a bracket 44 secured to the upper end of the left header 2 and an insert portion 45 resembling a pin and provided on the upper end of the receiver 7.

The bracket 44 is made from a metal, i.e., an aluminum plate, by press work for bending, and has a plurality of horizontal portions, i.e., a first horizontal portion 44*a* and a second horizontal portion 44*b* extending rightward from the portion 44*a* to a lower level. The bracket 44 has a bolt hole (not shown) formed in the upper first horizontal portion 44*a*, and a receiver holding circular through hole (not shown) formed in the lower second horizontal portion 44*b*. A bracket fastening bolt 46 upwardly projecting from the top wall of the left header 2 integrally therewith is inserted through the bolt hole of the first horizontal portion 44*a* from below, and a nut 47 is screwed on the upper end of the bolt 46, whereby the bracket 44 is removably fixed to the left header 2. The insert portion 45 is in the form of a pin circular in cross section, projecting upward from a wall closing the upper end of the liquid receiver 7, and integral with the wall, and is inserted through the receiver holding through hole. A tubular cushion member 48 is fitted around the insert portion 45. The cushion member 48 is made from a rubber, for example, a rubber selected from the group consisting of chloroprene rubber, ethylene-propylene-diene terpolymer, butadiene-acrylonitrile rubber and hydrogenated butadiene-acrylonitrile rubber. The cushion member 48 is provided around the insert portion 45 in the receiver holding through hole.

The unit-type heat exchanger 1 is fabricated by the process to be described next.

First, a pair of headers 2, 3 extending upward or downward and spaced apart from each other, a plurality of refrigerant tubes 4, a plurality of corrugated fins 5, upper and lower side plates 8, partition plates 12, 13, 14 and receiver connecting block 6 are positioned as specified and collectively brazed together.

A volatile lubricant is then applied to the outer peripheral surface of at least one of the fixing portion 22 of a receiver connecting block 6 and the fixing portion 36 of a liquid receiver 7, i.e., to the outer peripheral surface of the fixing portion 36 of the receiver 7, and a seal member 42 is thereafter fitted around the fixing portion 36 [see FIG. 4(*a*)]. The volatile lubricant to be used is preferably propylene glycol. The volatile lubricant may be applied to the outer peripheral surfaces of the two fixing portions 22, 36.

Subsequently, the fixing portion 22 of the connecting block 6 is placed on the fixing portion 36 of the liquid receiver 7, the male pipe portion 39 of the liquid receiver 7 and the male pipe portion 34 of the block 6 are fitted into the first channel 31 of the block 6 and the second channel 38 of the receiver 7, respectively, and the contact faces 22*a*, 36*a* of the two fixing portions 22, 36 are brought into intimate contact with each other. The liquid receiver 7 is then fixed to the block 6 in this state by driving male screws inserted through the bores 29 from below into the respective threaded bores of the receiver 7. The liquid receiver 7 is thereafter gripped with a clip 49, and the seal member 42 is pushed down for shifting by moving the clip 49 downward to fit the seal member 42 around both the fixing portions 22, 36 so as to cover the boundary between the contact faces 22, 36 of the two fixing portions 22, 36 [see FIG. 4(*b*)].

Finally, the bracket 44 is fastened to the left header 2, and the insert portion 45 on the liquid receiver 7 is inserted through the hole in the bracket 44. In this way, the unit-type heat exchanger 1 is fabricated.

The heat exchanger 1 provides a refrigeration cycle along with a compressor, expansion valve and evaporator, and the cycle is installed in a vehicle as an air conditioner.

A gaseous refrigerant compressed by a compressor and having a high temperature and high pressure flows into the condenser right header portion 3*a* through the refrigerant inlet member 18, is condensed while flowing zigzag through channel groups 15, 16, 17 within the condenser portion 10, flows into the condenser left header portion 2*a*, then flows through the first channel 31 of the connecting block 6 and the first channel 37 of the fixing portion 36 into the liquid receiver 7, in which extraneous matter and water are removed from the refrigerant. The refrigerant then flows through the second channel 38 of the fixing portion 36 and the second channel 32 of the block 6 into the supercooler left header portion 2*b*, is supercooled by 5 to 15° C. while flowing rightward through the refrigerant tubes 4, admitted into the supercooler right header portion 3*b* and thereafter sent through the outlet member 19 and expansion valve to an evaporator.

The embodiment described above is a heat exchanger of the invention as adapted for use as a unit-type heat exchanger which comprises a condenser and a supercooler as combined into a unit, whereas the heat exchanger of the invention can of course be embodied also as a single condenser separate from a supercooler.

Embodiment 2

The present invention is embodied as a structure for connecting pipes for use in a piping system for passing a refrigerant therethrough in a refrigeration cycle. This embodiment is shown in FIG. 6.

Figure 6:
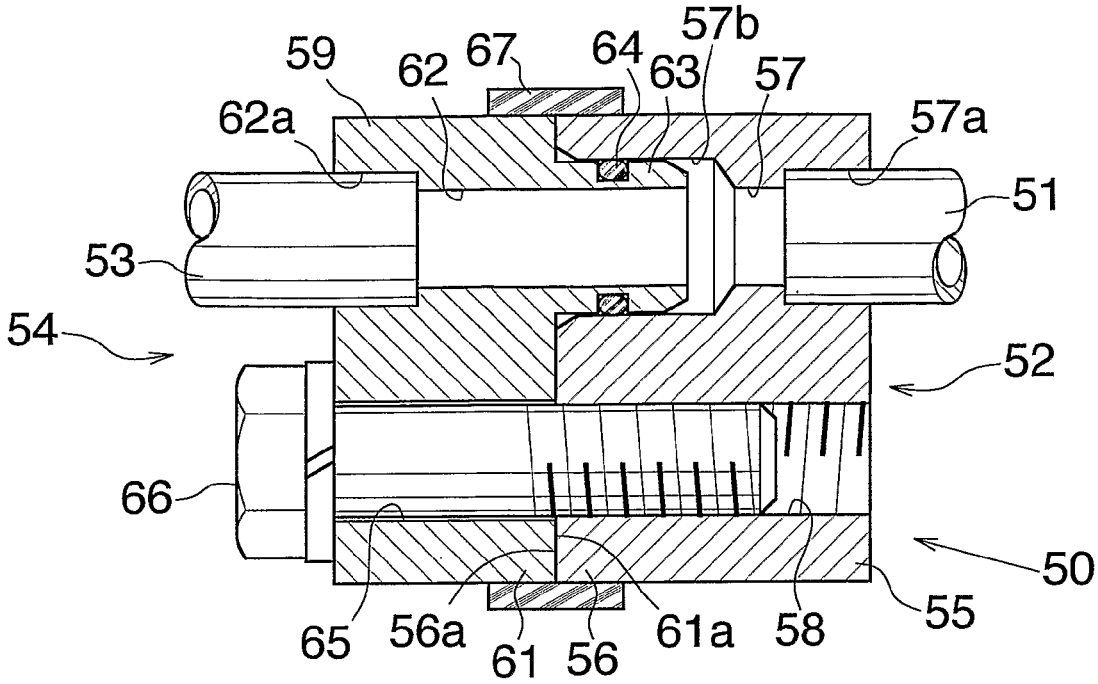
FIG. 6 is a view in longitudinal section showing a pipe connecting structure as an embodiment of connecting structure of the invention.

With reference to FIG. 6, the pipe connecting structure 50 comprises a first block 52 made of a metal, i.e., aluminum and fixed to an end of a first pipe 51 made of a metal, i.e., aluminum, and a second block 54 made of a metal, i.e., aluminum and fixed to an end of a second pipe 53 made of a metal, i.e., aluminum.

The first block 52 comprises a block body 55 and a fixing portion 56 formed at the left end of the block body 55 integrally therewith. With this embodiment, the block body 55 and the fixing portion 56 have the same shape and the same size in contour and are in the form of a vertically elongated oblong when seen from one side although not shown. The fixing portion 56 has a left side face serving as a flat intimate contact face 56*a*. The fixing portion 56 has a length of at least 5 mm in the left-right direction. The first block 52 has a channel 57 having one end opened in the right surface of the block body 55 and the other end opened in the intimate contact face 56*a* of the fixing portion 56. The channel 57 has a right end portion providing a first large-diameter portion 57*a*. The end of the first pipe 51 is inserted into the first large-diameter portion 57*a* and secured to the first block 52 by welding. The channel 57 has a second large-diameter portion 57*b* formed on the left side of a lengthwise midportion thereof. The first block 52 has a threaded bore 58 extending therethrough in the left-right direction.

The second block 54 comprises a block body 59 and a fixed portion 61 formed at the right end of the block body 59 integrally therewith. With this embodiment, the block body 59 and the fixing portion 61 have the same shape and the same size in contour and are in the form of a vertically elongated oblong having the same shape and the same size as the block body 55 and the fixing portion 56 of the first block 52 when seen from one side although not shown. The fixing portions 56, 61 may be slightly different in the shape and size of the contours of their outer peripheries. The fixing portion 61 has a right side face serving as a flat intimate contact face 61*a*. The fixing portion 61 has a length of at least 5 mm in the left-right direction. The second block 54 has a channel 62 having one end opened in the left surface of the block body 59 and the other end opened in the intimate contact face 61*a* of the fixing portion 61 and communicating with the channel 57 of the first block 52. The channel 62 has a left end portion providing a large-diameter portion 62*a*. The end of the second pipe 53 is inserted into the large-diameter portion 62*a* and secured to the second block 54 by welding. A male pipe portion 63 projecting rightward and to be inserted into the second large-diameter portion 57*b* of the channel 57 in the first block 52 is formed around the opening of the channel 62 in the contact face 61*a* of the fixing portion 61 integrally with this portion 61. An O-ring 64 is provided around the male pipe portion 63. A bore 65 extends in the left-right direction through the second block 54 in alignment with the threaded bore 58 of the first block 52.

The two blocks 52, 54 are fastened together by driving a male screw 66 inserted through the bore 65 of the second block 54 from the left into the threaded bore 58 in the first block 52, with the male pipe portion 64 of the second block 54 fitted in the second large-diameter portion 57*b* of the channel 57 in the first block 52 and with the contact faces 56*a*, 61*a* of the fixing portions 56, 61 of the two blocks 52, 54 in intimate contact with each other, whereby the channels 57, 62 of the two blocks 52, 54 are caused to communicate with each other, and the two pipes 51, 53 are connected together by the two blocks 52, 54.

A tubular seal member 67 is liquid-tightly provided around the two fixing portions 56, 61 so as to cover the boundary between the contact faces 56*a*, 61*a* of the fixing portions 56, 61 of the two blocks 52, 54. For the same reason as is the case with Embodiment 1, it is desired that the seal member 67 cover the outer peripheral surfaces of the fixing portions 56, 61 of the blocks 52, 54 each over a length of at least 5 mm in the direction of thickness of the fixing portion (left-right direction). The tubular seal member 67 has rubberlike elasticity. The seal member 67, which has an inside diameter smaller than the outside diameter of the fixing portions 56, 61 of the two blocks 52, 54, is elastically deformed and fitted around the fixing portions 56, 61 of the two blocks 52, 54 in intimate contact with the outer peripheral surfaces of both the fixing portions 56, 61 by virtue of its own elasticity. Stated more specifically, the seal member 67 is made from a rubber selected from the group consisting of silicone rubber, ethylene propylene rubber, butadiene-acrylonitrile rubber and hydrogenated butadiene-acrylonitrile rubber. Before being fitted around the fixing portions, the seal member 67 is similar to the outer peripheral surfaces of the two fixing portions 56, 61 in shape and has an inner shape smaller than the contours of the fixing portions 56, 61.

Although not shown, it is desirable that the seal member 67 be provided on the inner peripheral surface thereof with a plurality of annular seal grooves over the entire circumference thereof for the same reason as is the case with Embodiment 1.

The pipe connecting structure is fabricated by the process to be described below.

Pipes 51, 53 are fixed to respective blocks 52,54 by welding first.

A volatile lubricant is then applied to the outer peripheral surface of at least one of the fixing portions 56, 61 of the two blocks 52, 54, and a seal member 67 is fitted around the fixing portion 56 or 61 having the lubricant applied thereto.

The two blocks 52, 54 are subsequently fastened together by driving a male screw 66 inserted through the bore 65 from the left into the threaded bore 58 of the first block 52, with the male pipe portion 63 of the second block 54 inserted in the second large-diameter portion 57*b* of the channel 57 of the first block 52 to bring the contact faces 56*a*, 61*a* of the two fixing portions 56, 61 into intimate contact with each other. The tubular seal member 67 is thereafter shifted in the same manner as in the case of Embodiment 1 to fit the tubular seal member 67 around the two fixing portions 56, 61 so as to cover the boundary between the contact faces 56*a*, 61*a* of the two fixing portions 56, 61. In this way, the pipe connecting structure 50 is fabricated.

Embodiment 3

Figure 7:
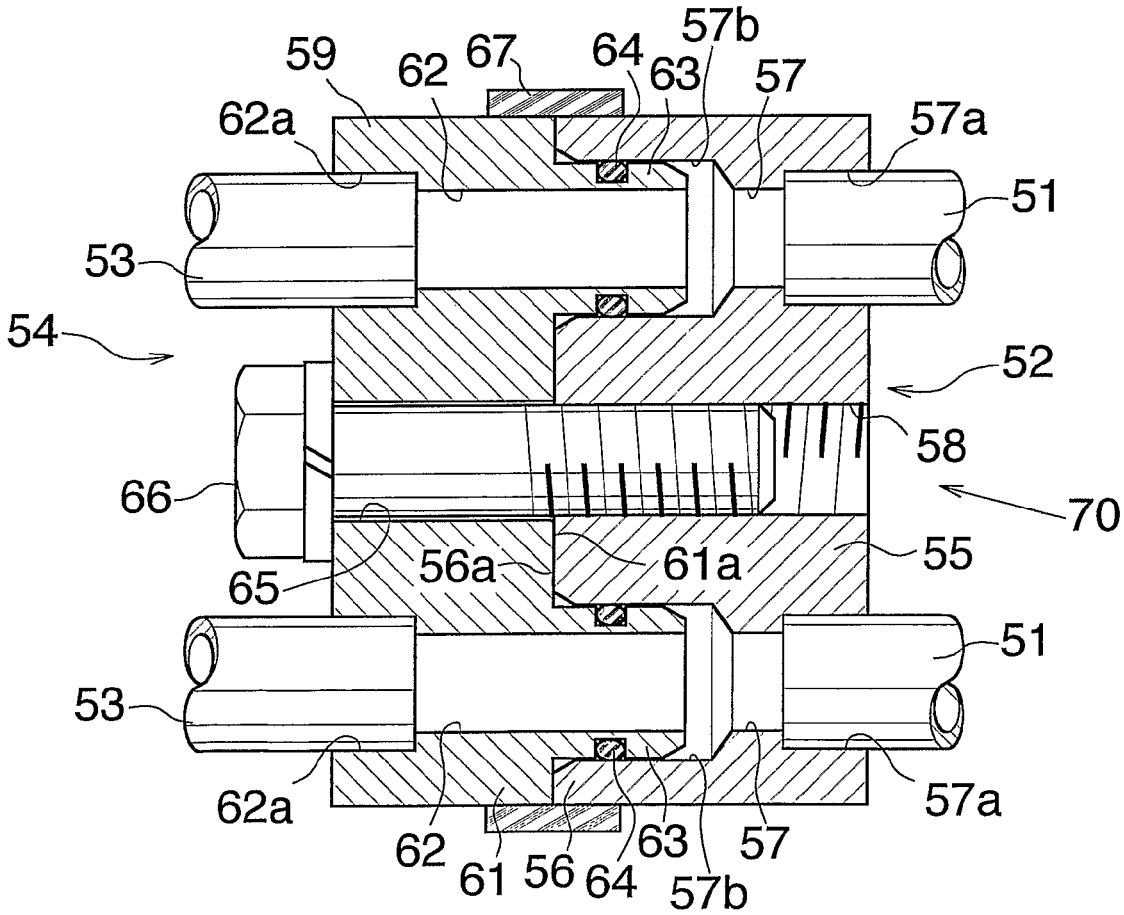
FIG. 7 is a view in longitudinal section showing a pipe connecting structure as another embodiment of connecting structure of the invention.

The present invention is embodied as a structure 70 for connecting pipes for use in a piping system for passing a refrigerant therethrough in a refrigeration cycle. This embodiment is shown in FIG. 7.

In the case of the pipe connecting structure 70 of this embodiment, a first block 52 is secured to both the forward ends of two first pipes 51, and a second block 54 is secured to both the forward ends of two second pipes 53. The structure 70 has the same construction as the pipe connecting structure 50 of Embodiment 2 described with the exception of the following features. The blocks 52, 54 have two channels 57 and two channels 62, respectively. The ends of the pipes 51, 53 are inserted into respective large-diameter portions 57*a*, 62*a* of the channels 57, 62 and secured to the corresponding blocks 52, 54 by welding. A male pipe portion 63 projecting rightward and to be inserted into a second large-diameter portion 57*b* of each channel 57 of the first block 52 is formed around the opening of each channel 62 in an intimate contact face 61*a* of a fixing portion 61 of the second block 54. In FIGS. 6 and 7, like parts are designated by like reference numerals.

The pipe connecting structure 70 of Embodiment 3 is fabricated in the same manner as the structure 50 of Embodiment 2.

Embodiment 4

The present invention is embodied as a structure 80 for connecting pipes for use in a piping system for passing a refrigerant therethrough in a refrigeration cycle. This embodiment is shown in FIG. 8.

Figure 8:
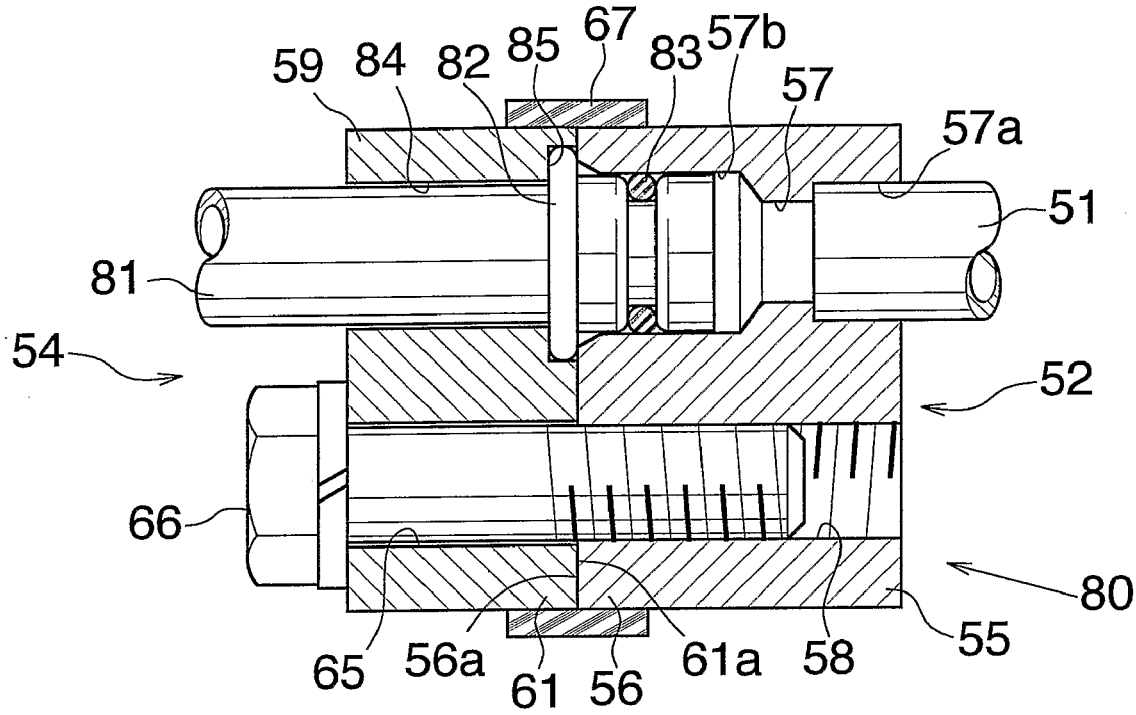
FIG. 8 is a view in longitudinal section showing a pipe connecting structure as another embodiment of connecting structure of the invention.

With reference to FIG. 8, the pipe connecting structure 80 comprises a first block 52 made of a metal, i.e., aluminum and fixed to an end of a first pipe 51 made of a metal, i.e., aluminum, a second pipe 81 made of a metal, i.e., aluminum, and a second block 54 made of a metal, i.e., aluminum for fixing the second pipe 81 to the first block 52.

An annular ridge 82 is formed on the second pipe 81 close to the forward end thereof, and an O-ring 83 is fitted around a portion of the pipe 81 closer to the forward end (right side) than the annular ridge 82.

Instead of the channel 62 of the second block 54 of Embodiment 2, the second block 54 has a pipe insertion bore 84 having one end opened in the left end face of a block body 59 and the other end opened to an intimate contact face 61*a* of affixing portion 61. A recessed portion 85 for the annular ridge 82 of the second pipe 81 to fit in is formed in the contact face 61*a* of the fixing portion 61 around the pipe insertion hole 84. No male pipe portion is provided.

The portion of the second pipe 81 closer to the base end thereof (left side) than the annular flange 82 is inserted through the pipe insertion bore 84 of the second block 54, and the annular ridge 82 is fitted in the recessed portion 85. The portion of the second pipe 81 closer to the forward end thereof than the annular ridge 82 is fitted in a second large-diameter portion 57*b* of a channel 57 of the first block 52. The two blocks 52, 54 are fastened together by driving a male screw 66, inserted through a bore 65 extending through the second block 54 from the left, into a threaded bore 58 in the first block 52, with the contact faces 56*a*, 61*a* of fixing portions 56, 61 of the two blocks 52, 54 in intimate contact with each other. The channel 57 of the first block 52 is held in communication with the second pipe 81, and the two pipes 51, 81 are connected together by the two blocks 52, 54.

With the exception of these features, the structure 80 is the same as the pipe connecting structure 50 of Embodiment 2, and throughout the drawings concerned, like parts are designated by like reference numerals.

With the pipe connecting structures 70, 80 of Embodiments 3 and 4, it is also desirable that the tubular seal member 67 be provided in the inner peripheral surface thereof with a plurality of annular grooves over the entire circumference.

The pipe connecting structure 80 is fabricated by the process to be described below.

The first pipe 51 is secured by welding to the first block 52 first. The portion of the second pipe 81 closer to the base end thereof than the annular ridge 82 is inserted through the pipe insertion bore 84 of the second block 54.

A volatile lubricant is then applied to the outer peripheral surface of one of the fixing portions 56, 61 of the two blocks 52, 54, and the tubular seal member 67 is fitted around the fixing portion 56 or 61 having the lubricant applied thereto. The two blocks 52, 54 are subsequently fastened together by driving the male screw 66, inserted through the bore 65 from the left, into the threaded bore 58 of the first block 52, with the portion of the second pipe 81 closer to the forward end thereof than the annular ridge 82 inserted into the second large-diameter portion 57*b* of the channel 57 of the first block 52 and with the contact faces 56*a*, 61*a* of fixing portions 56, 61 of the two blocks 52, 54 in intimate contact with each other. The tubular seal member 67 is then shifted and fitted around the two fixing portions 56, 61 in the same manner as in the case of Embodiment 1 to cover the boundary between the contact faces 56*a*, 61*a* of the fixing portions 56, 61. In this way, the pipe connecting structure 80 is fabricated.

Although pipes serving as refrigerant passage portions of the refrigeration cycle are connected to each other by the structure of the present invention, this mode of connection is not limitative; the pipe connecting structure of the invention is usable also for connecting a header serving as a refrigerant passage portion of an evaporator or condenser to a pipe as a refrigerant passage portion. In this case, the first block in one of Embodiments 2 to 4 is connected directly to the header so that the channel of the block will communicate with the interior of the header.

INDUSTRIAL APPLICABILITY

The heat exchanger and the refrigerant passage portion connecting structure of the present invention are suitable for use in refrigeration cycles providing, for example, motor vehicle air conditioners.

The invention claimed is:

1. A heat exchanger comprising:

a pair of headers extending in a vertical direction and spaced apart from each other, the headers including a receiver-fixed header;

a plurality of refrigerant tubes arranged one above another in parallel at a spacing between the pair of headers and having opposite ends joined to the respective headers;

a plurality of fins arranged between respective adjacent pairs of the refrigerant tubes;

a liquid receiver fixed to the receiver-fixed header; and a receiver connecting block fixed to a peripheral wall of the receiver-fixed header and having a plurality of channels communicating an interior portion of the receiver-fixed header with an interior portion of the liquid receiver therethrough, wherein the liquid receiver is fixed to the connecting block, the connecting block and the liquid receiver is provided with respective fixing portions having respective contact faces in intimate contact with each other, the fixing portions of the connecting block and the liquid receiver have outer peripheral surfaces which are cylindrical surfaces sharing a same outside diameter, the liquid receiver is fixed to the connecting block by at least one screw with the contact faces of the fixing portions in intimate contact with each other, a seal member is liquid-tightly provided around respective outer peripheral surfaces of the fixing portions of the connecting block and the liquid receiver so as to cover a boundary between the contact faces of the fixing portion of the block and the fixing portion of the liquid receiver, the seal member is tubular and has rubber elasticity, and the seal member has an inner shape smaller than contours of the outer peripheral surfaces of the fixing portions of the block and the liquid receiver and is fitted as elastically deformed around the fixing portion of the connecting block and the fixing portion of the liquid receiver in intimate contact with the outer peripheral surfaces of the fixing portions by elastic force of the seal member.

2. A heat exchanger according to claim 1 wherein the outer peripheral surfaces of the fixing portions of the block and the liquid receiver have respective contours of the same shape and the same size.

3. A heat exchanger according to claim 1 wherein the seal member covers the outer peripheral surfaces of the fixing portion of the block and the fixing portion of the liquid receiver each over a length of at least 5 mm in the direction of thickness of the fixing portion.

4. A heat exchanger according to claim 1 wherein the tubular seal member is provided in an inner peripheral surface thereof with a plurality of annular seal grooves over the entire circumference thereof.

5. A heat exchanger according to claim 1 wherein the outer peripheral surfaces of the fixing portions of the block and the liquid receiver have respective contours of the same shape and the same size, are each in the form of a cylindrical surface and each have a circular contour, the tubular seal member being cylindrical, and assuming that the outside diameter of the fixing portions of the block and the liquid receiver is d and that the inside diameter of the tubular seal member to be fitted around the fixing portions is D, these diameters have the relationship of $0.7d<D<d$.

6. A heat exchanger according to claim 1 wherein the tubular seal member is made from a rubber selected from the group consisting of silicone rubber, ethylene propylene rubber, butadiene-acrylonitrile rubber and hydrogenated butadiene-acrylonitrile rubber.

7. A heat exchanger according to claim 1 wherein the seal member comprises a thermally shrinkable tube.

8. A unit-type heat exchanger comprising a heat exchanger according to claim 1 wherein the headers are internally divided at portions thereof at a same level to thereby provide a condenser portion and a supercooler portion positioned below the condenser portion, the receiver connecting block having channels permitting a refrigerant flowing out of the condenser portion to pass through the interior portion of the liquid receiver and to flow into the supercooler portion.

9. A refrigeration cycle having a compressor, a condenser, an expansion valve and an evaporator, the condenser comprising a heat exchanger according to claim 1.

10. A vehicle having installed therein the refrigeration cycle according to claim 9 as an air conditioner.

11. A refrigeration cycle comprising a compressor, a unit-type heat exchanger according to claim 8, an expansion valve and an evaporator.

12. A vehicle having installed therein the refrigeration cycle according to claim 11 as an air conditioner.

13. A process for fabricating a heat exchanger according to claim 1 including:

arranging a plurality of refrigerant tubes one above another in parallel at a spacing between a pair of headers extending upward or downward and spaced apart from each other, arranging fins between respective adjacent pairs of heat exchange tubes, providing a receiver connecting block for one of the headers and collectively brazing the resulting arrangement, applying a volatile lubricant to an outer peripheral surface of at least one of a fixing portion of the block and a fixing portion of a liquid receiver and thereafter fitting a tubular seal member around the outer peripheral surface of the fixing portion having the lubricant applied thereto, and fastening the liquid receiver to the block with contact faces of the fixing portions of the block and the liquid receiver in intimate contact with each other and thereafter shifting the tubular seal member to place the tubular seal member around both the fixing portions so as to cover a boundary between the contact faces of the fixing portions.

14. A refrigerant passage portion connecting structure for a refrigeration cycle comprising:

two blocks each having a channel communicating with a refrigerant passage portion of a refrigeration cycle, the two blocks having respective fixing portions and respective contact faces each provided on a respective one of the fixing portions and to be positioned in intimate contact with each other, the channel having one end opened in the contact face, the fixing portions of the two blocks have outer peripheral surfaces which are cylindrical surfaces sharing a same outside diameter, the two blocks being fastened together with the contact faces of the fixing portions by at least one screw in intimate contact with each other and with the channels communicating with each other; and a seal member liquid-tightly provided around outer peripheral surfaces of the fixing portions of the two blocks so as to cover a boundary between the contact faces of the fixing portions, wherein the seal member is tubular and has rubber elasticity, and the seal member has an inner shape smaller than contours of the outer peripheral surfaces of the fixing portions of the two blocks and is fitted as elastically deformed around the fixing portions of the two blocks in intimate contact with the outer peripheral surfaces of the fixing portions by elastic force of the seal member.

15. A refrigerant passage portion connecting structure for a refrigeration cycle according to claim 14 wherein the outer peripheral surfaces of the fixing portions of the two blocks have respective contours of the same shape and the same size.

16. A refrigerant passage portion connecting structure for a refrigeration cycle according to claim 14 wherein the seal member covers the outer peripheral surfaces of the fixing portions of the two blocks each over a length of at least 5 mm in the direction of thickness of the fixing portion.

17. A refrigerant passage portion connecting structure for a refrigeration cycle according to claim 14 wherein the tubular seal member is provided in an inner peripheral surface thereof with a plurality of annular seal grooves over the entire circumference thereof.

18. A refrigerant passage portion connecting structure for a refrigeration cycle according to claim 14 wherein the outer peripheral surfaces of the fixing portions of the two blocks have respective contours of the same shape and the same size, are each in the form of a cylindrical surface and each have a circular contour, the tubular seal member being cylindrical, and assuming that the outside diameter of the fixing portions of the two blocks is d and that the inside diameter of the tubular seal member to be fitted around the fixing portions is D, these diameters have the relationship of $0.7d<D<d$.

19. A refrigerant passage portion connecting structure for a refrigeration cycle according to claim 15 wherein the tubular seal member is made from a rubber selected from the group consisting of silicone rubber, ethylene propylene rubber, butadiene-acrylonitrile rubber and hydrogenated butadiene-acrylonitrile rubber.

20. A refrigerant passage portion connecting structure for a refrigeration cycle according to claim 14 wherein the seal member comprises a thermally shrinkable tube.

21. A process for fabricating a refrigerant passage portion connecting structure for a refrigeration cycle according to claim 14 including:

applying a volatile lubricant to an outer peripheral surface of a fixing portion of at least one of two blocks and thereafter fitting a tubular seal member around the outer peripheral surface of the fixing portion having the lubricant applied thereto, and fastening the two blocks together with contact faces of the fixing portions of the blocks in intimate contact with each other and thereafter shifting the tubular seal member to place the tubular seal member around both the fixing portions so as to cover a boundary between the contact faces of the fixing portions.

22. A heat exchanger according to claim 1 wherein the seal member has a lower end portion which is in contact with the connecting block.

23. A refrigerant passage portion connecting structure according to claim 14 wherein the seal member has a lower end portion which is in contact with one of the connecting blocks.

* * * * *